US006179997B1

(12) United States Patent
Vedder, Jr. et al.

(10) Patent No.: US 6,179,997 B1
(45) Date of Patent: Jan. 30, 2001

(54) ATOMIZER SYSTEM CONTAINING A PERFORATED PIPE SPARGER

(75) Inventors: William J. Vedder, Jr., Sugar Land, TX (US); Jan W. Wells, Bartlesville, OK (US)

(73) Assignee: Phillips Petroleum Company, Bartlesville, OK (US)

( * ) Notice: Under 35 U.S.C. 154(b), the term of this patent shall be extended for 0 days.

(21) Appl. No.: 09/358,220

(22) Filed: Jul. 21, 1999

(51) Int. Cl.[7] ..... C10G 11/00; C10G 9/32; B05B 7/00; B05B 7/04

(52) U.S. Cl. ..... 208/113; 208/127; 208/153; 208/157; 239/8; 239/398; 239/429; 239/431; 239/433; 239/434; 239/589

(58) Field of Search ..... 208/113, 153, 208/157, 127; 239/398, 429, 431, 433, 434, 589, 8; 137/896

(56) References Cited

U.S. PATENT DOCUMENTS 3,332,442 * 7/1967 Reed ..... 137/896
4,103,827 * 8/1978 Kumazawa ..... 239/8
4,960,502 10/1990 Holland ..... 208/85
5,037,616 * 8/1991 Williatte et al. ..... 422/140
5,108,583 * 4/1992 Keon ..... 208/157
5,173,175 12/1992 Steffens et al. ..... 208/157
5,673,859 * 10/1997 Haruch ..... 239/568
5,979,799 * 11/1999 Chen et al. ..... 239/430
6,003,789 * 12/1999 Base et al. ..... 239/433
6,098,896 * 8/2000 Haruch ..... 239/8

OTHER PUBLICATIONS

Perry's Chemical Engineers Handbook, 6th Edition, Section 5, pp. 48–49 (No Date Available).

Hemanta Mukherjee, "The University of Tulsa Fluid Flow Projects—An Experimental Study of Inclined Two–Phase Flow", Dec. 30, 1979, pp. 60 and 102–104.

* cited by examiner

*Primary Examiner*—Walter D. Griffin
(74) *Attorney, Agent, or Firm*—Jeffrey R. Anderson

(57) ABSTRACT

A novel apparatus and process, including a perforated-pipe sparger, for atomizing a liquid stream is disclosed. This novel apparatus and process can be utilized in a fluidized catalytic cracking process or in a coking process for atomizing an oil stream prior to contact with a fluidized catalyst.

23 Claims, 6 Drawing Sheets

ATOMIZER SYSTEM CONTAINING A PERFORATED PIPE SPARGER

The present invention relates to the atomization of a liquid stream. In another aspect, the invention relates to a method and apparatus for atomizing and uniformly distributing an oil feed stream into a stream of fluidized catalyst in a fluidized catalytic cracking (FCC) unit or a coker unit.

BACKGROUND OF THE INVENTION

The process of atomizing a liquid stream for such purposes as rapid cooling of the liquid (artificial snow making) or enhanced contact of the atomized liquid with another medium, such as a fluidized catalyst, is well known in the art. It would clearly be desirable to provide an improved process and apparatus for atomizing a liquid stream.

A specific example of an atomization process is the atomization of an oil stream in an FCC or coker unit prior to contacting the oil stream with a fluidized catalyst. Typical FCC unit operations are described below.

Fluidized catalytic cracking of heavy petroleum fractions to produce products such as gasoline and heating oils is well known in the art. In fluidized catalytic cracking, heavy petroleum fractions are often preheated prior to contact with hot, fluidized catalyst particles in a riser reactor. The contact time in the riser reactor is generally in the order of a few seconds. The relatively short contact time encourages the production of gasoline and heating oil range hydrocarbons. Longer contact times can result in overcracking to undesirable end products, such as methane and coke. Important aspects of contacting the heavy petroleum fraction with the fluidized catalyst include the atomization of the heavy petroleum fraction and uniform distribution of the atomized heavy petroleum fraction within the fluidized catalyst. Non-uniform distribution of the heavy petroleum fraction in the fluidized catalyst can lead to localized regions of high catalyst-to-oil ratios and overcracking. Also, poor atomization of the heavy petroleum fraction can lead to localized regions of low catalyst-to-oil ratios resulting in wetting of the catalyst which results in increased coke laydown. In addition, if the heavy petroleum fraction is not sufficiently atomized and does not directly contact the fluidized catalyst upon injection into the riser reactor, then thermal cracking can occur instead of catalytic cracking. Thermal cracking can result in the generation of the undesirable end products of methane and coke. Excess coke is undesirable because the process duties of the stripper and regenerator are increased and the coke can be deposited on the surfaces of the equipment involved. It would be clearly desirable to provide a process and apparatus in which an oil feed stream comprising a heavy petroleum fraction is sufficiently atomized and uniformly distributed within a fluidized catalyst in a fluidized catalytic cracking process.

SUMMARY OF THE INVENTION

It is an object of the present invention to provide an apparatus to be used in the atomization of a liquid stream in a more efficient manner.

A further object of this invention is to provide a method of atomizing a liquid stream in a manner that increases the atomization efficiency.

It is yet another object of the present invention to improve the efficiency of FCC operations.

It is still another object of the present invention to improve the efficiency of coker operations.

Another object of the present invention is to provide a method and apparatus for atomizing an oil feed stream for catalytic conversion.

A yet further object of the present invention is to provide a method and apparatus for atomizing and uniformly distributing an oil feed stream into a fluidized catalyst.

In accordance with the present invention, the atomizer comprises:

a first conduit having a longitudinal axis, an inside wall, an inside diameter $D_1$, an upstream end portion, a downstream end portion, and an opening in the inside wall intermediate said upstream end portion and said downstream end portion;

a second conduit having a perforated-pipe sparger at one end thereof for introducing an atomizing enhancing medium to the first conduit; the perforated-pipe sparger having a longitudinal axis and being disposed within the first conduit through the opening in the inside wall of the first conduit with the longitudinal axis of the perforated-pipe sparger being in a generally perpendicular relation to the longitudinal axis of the first conduit; the perforated-pipe sparger having an outside surface, a first end, a closed second end, an outside diameter $D_2$, a length $L_1$ within the first conduit and a plurality of holes facing generally in the direction of the downstream end portion of the first conduit; the outside surface at the first end of the perforated-pipe sparger being in sealing engagement with the opening in the inside wall of the first conduit; and a third conduit having an inside diameter $D_3$, the third conduit being connected in fluid flow communication with the downstream end portion of the first conduit.

The invention further includes a method of operating the inventive atomizer described above. More particularly, the inventive method for atomizing a liquid stream comprises:

providing the atomizer described above;

introducing a liquid stream to the upstream end portion of the first conduit;

introducing an atomizing enhancing medium through the perforated-pipe sparger via the second conduit;

contacting the liquid stream with the atomizing enhancing medium downstream from the plurality of holes of the perforated-pipe sparger thereby forming a turbulent mixture of the liquid stream and the atomizing enhancing medium;

passing the turbulent mixture to the third conduit thereby converting the turbulent mixture into an annular-mist flow mixture;

passing the annular-mist flow mixture to a nozzle; and withdrawing the annular-mist flow mixture from the nozzle thereby at least partially atomizing the liquid stream to form an atomized liquid stream.

Other objects and advantages of the invention will be apparent from the detailed description of the invention and the appended claims.

DETAILED DESCRIPTION OF THE INVENTION

The apparatus and process of the present invention will be described with reference to the drawings. Reference to the specific configurations of the drawings is not meant to limit the invention to the details of the drawings disclosed in conjunction therewith.

Figure 1:
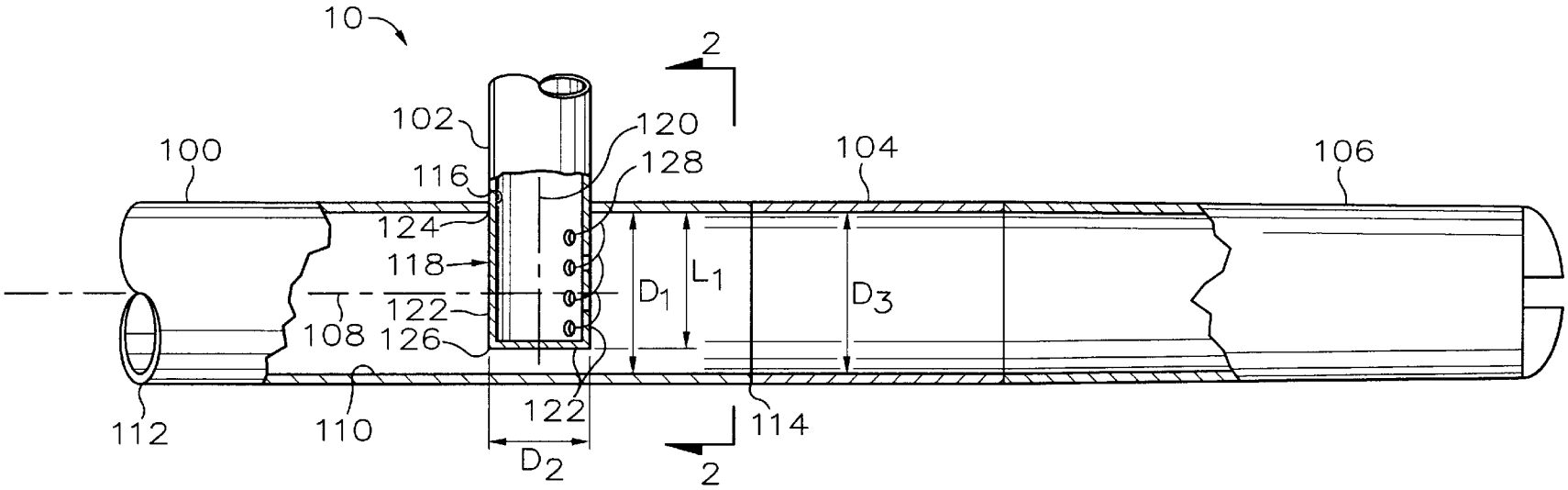
FIG. 1 is a partially cut-away elevation showing certain features of the inventive atomizer.
Figure 2:
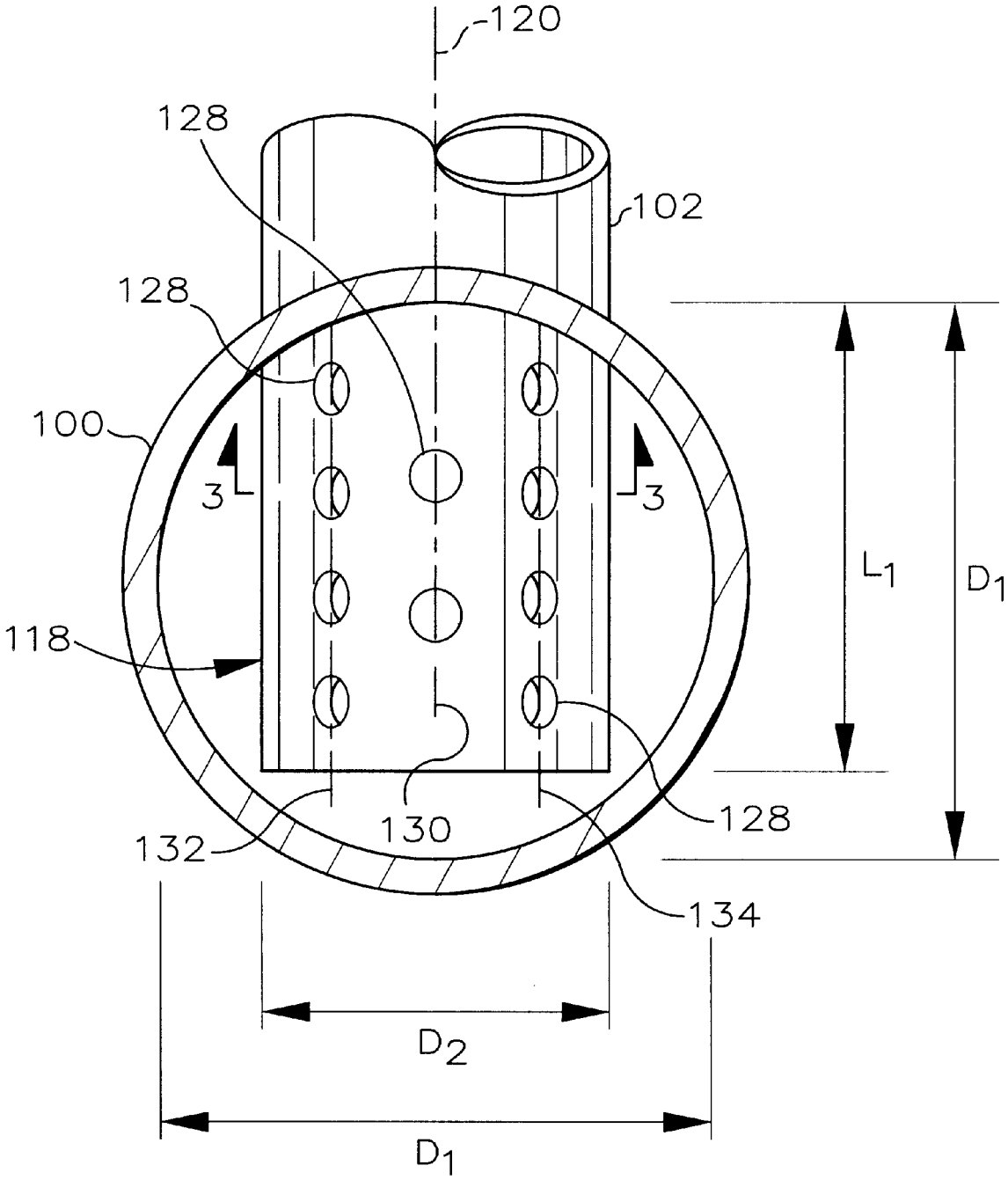
FIG. 2 is a section taken across line 2—2 of FIG. 1 showing in greater detail certain features of the inventive atomizer shown in FIG. 1.
Figure 3:
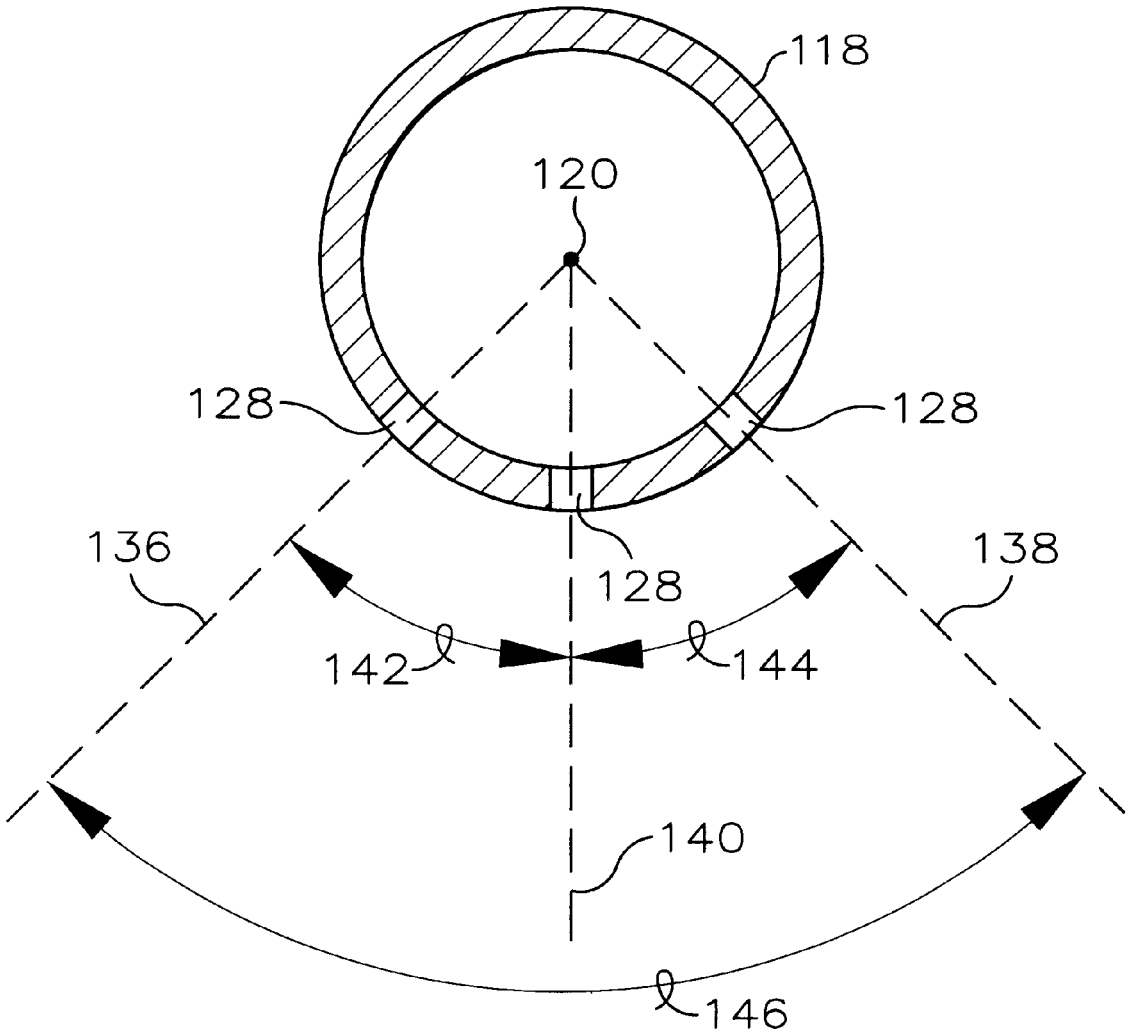
FIG. 3 is a section taken across line 3—3 of FIG. 2 showing in greater detail certain features of the inventive atomizer shown in FIGS. 1 and 2.

Referring to FIGS. 1–3, and in particular FIG. 1, therein is illustrated the inventive atomizer 10 including a first conduit 100, a second conduit 102, a third conduit 104, and, optionally, a nozzle 106. The first conduit 100 has a longitudinal axis 108, an inside wall 110, an inside diameter $D_1$, an upstream end portion 112, a downstream end portion 114 and an opening 116 in the inside wall 110 intermediate the upstream end portion 112 and the downstream end portion 114.

The second conduit 102 has a perforated-pipe sparger 118 connected in fluid flow communication at one end thereof. The perforated-pipe sparger 118 has a longitudinal axis 120, an outside surface 122, a first end 124, a closed second end 126, an outside diameter $D_2$, a length $L_1$ within first conduit 100, and a plurality of holes 128. The perforated-pipe sparger 118 is disposed within the first conduit 100 through opening 116 in the inside wall 110 with the longitudinal axis 120 of perforated-pipe sparger 118 being in a generally perpendicular relation to the longitudinal axis 108 of the first conduit 100. The plurality of holes 128 face generally in the direction of the downstream end portion 114 of first conduit 100. The outside surface 122 at the first end 124 of the perforated-pipe sparger 118 is in sealing engagement with opening 116 in the inside wall 110 of the first conduit 100. The outside surface 122 of perforated-pipe sparger 118 and the inside wall 110 of first conduit 100 define a first cross sectional area ($A_{xs1}$) within the first conduit 100 which is generally in a perpendicular relation to the longitudinal axis 108 of the first conduit 100 and is generally parallel to the longitudinal axis 120 of perforated-pipe sparger 118. The plurality of holes 128 have a total second cross sectional area ($A_{xs2}$).

Referring to FIGS. 2 and 3, the plurality of holes 128 of the perforated-pipe sparger 118 can be further characterized to include a plurality of rows of holes, each row generally parallel to the longitudinal axis 120 of perforated-pipe sparger 118 and including, but not limited to, a center row lying along dashed line 130, a first side row lying along dashed line 132 and a second side row lying along dashed line 134. The axes of the holes in the first side row along line 132 lie in a first plane 136 intersecting longitudinal axis 120 of perforated-pipe sparger 118. The axes of the holes in the second side row along line 134 lie in a second plane 138 intersecting the longitudinal axis 120 of perforated-pipe sparger 118. The axes of the holes in the center row along line 130 lie in a third plane 140 intersecting the longitudinal axis 120 of perforated-pipe sparger 118.

Referring to FIG. 3, a first angle 142 formed between first plane 136 and third plane 140 can be in the range of from about 40° to about 50°, preferably in the range of from about 42° to about 48°, and most preferably from 43° to 47°. A second angle 144 formed between second plane 138 and third plane 140 can be in the range of from about 40° to about 50°, preferably in the range of from about 42° to about 48°, and most preferably from 43° to 47°. A third angle 146 formed between first plane 136 and second plane 138 can be in the range of from about 80° to about 100°, preferably in the range of from about 84° to about 96°, and most preferably from 86° to 94°.

In a preferred embodiment, the first side row along line 132 and the second side row along line 134 can include in the range of from about 70% to about 90%, preferably in the range of from about 73% to about 87%, and most preferably from 75% to 85% of the total second cross sectional area of the plurality of holes 128 in perforated-pipe sparger 118.

Preferably, $(D_1-D_2)/2$ is substantially equivalent to $(D_1-L_1)$ allowing substantially uniform flow of a liquid stream throughout the first cross sectional area $A_{xs1}$.

Referring again to FIG. 1, third conduit 104 has an inside diameter $D_3$ and is connected in fluid flow communication with first conduit 100. Third conduit 104 is optionally connected in fluid flow communication with nozzle 106.

Referring again to FIG. 1, and the operation of the atomizer 10, a liquid stream is introduced to the upstream end portion 112 of first conduit 100. The liquid stream then flows around perforated-pipe sparger 118 through the first cross sectional area ($A_{xs1}$).

$A_{xs1}$ preferably has a value such that the mass flux of the liquid stream ($MF_1$) around perforated-pipe sparger 118 is in the range of from about 625 lbm/(ft$^2$ sec) to about 1050 lbm/(ft$^2$ sec); preferably in the range of from about 700 lbm/(ft$^2$ sec) to about 975 lbm/(ft$^2$ sec); and most preferably from 775 lbm(ft$^2$ sec) to 900 lbm/(ft$^2$ sec). The mass flux of the liquid stream is defined by the formula:

$$MF_1 = \frac{m_1}{A_{xs1}};$$

$m_1$=mass flow rate of the liquid stream in lbm/sec; and $A_{xs1}$=cross sectional area in ft$^2$.

An atomizing enhancing medium is introduced to second conduit 102, flows into perforated-pipe sparger 118 of second conduit 102 and exits perforated-pipe sparger 118 through the total second cross sectional area $A_{xs2}$ of the plurality of holes 128. $A_{xs2}$ preferably has a value such that the mass flux of the atomizing enhancing medium ($MF_2$) at the point of exit from the plurality of holes 128 is in the range of from about 30 lbm/(ft$^2$ sec) to about 50 lbm/(ft$^2$ sec), preferably in the range of from about 32 lbm/(ft$^2$ sec) to about 48 lbm/(ft$^2$ sec;) and most preferably from 35 lbm/(ft$^2$ sec) to 45 lbm/(ft$^2$ sec). The mass flux of the atomizing enhancing medium is defined by the formula:

$$MF_2 = \frac{m_2}{A_{xs2}};$$

$m_2$=mass flow rate of the atomizing enhancing medium in lbm/sec; and $A_{xs2}$=cross sectional area in ft$^2$.

Upon exit from the plurality of holes 128, the atomizing enhancing medium contacts the liquid stream thereby forming a turbulent mixture of the liquid stream and the atomizing enhancing medium. The atomizing enhancing medium has a gas velocity number ($N_{gv}$) and the liquid stream has a liquid velocity number ($N_{LV}$), both defined below. Preferably, diameter $D_3$ of third conduit 104 has a value such that, as $N_{LV}$ is varied, $N_{gv}$ exceeds:

$10^z$; wherein:

$z=(1.401-2.694\ N_L+0.521(N_{LV})^{0.329})$;

$N_{gv}=V_{sg}(\rho_L\ g_c/g\sigma_L)^{1/4}$;

$N_{Lv}=V_{sL}(\rho_L\ g_c/g\sigma_L)^{1/4}$;

$$V_{sg}=\frac{m_2}{A_{xs3}\rho_v};$$

$$V_{sL}=\frac{m_1}{A_{xs3}\rho_L};$$

$A_{xs3}=\pi(D_3)^2/4$ $N_L$=viscosity of the liquid stream in lbm/ft sec;

$\rho_L$=the liquid stream density in lbm/ft$^3$;

$\rho_v$=the atomizing enhancing medium density in lbm/ft$^3$;

$g_c$=gravitational constant;

g=acceleration due to gravity;

$\sigma_L$=surface tension of the liquid stream in lbf/ft; and $A_{xs3}$=cross sectional area of the third conduit in ft$^2$.

Where the value of $D_3$ is as described above, the turbulent mixture, upon passing from downstream end portion 114 of first conduit 100 to third conduit 104, will be converted in third conduit 104 to an annular-mist flow mixture which is necessary in order to produce atomization of the liquid stream at the exit of the nozzle. The annular-mist flow mixture is preferably substantially circumferentially uniform. The annular-mist flow mixture can then be passed to nozzle 106 from which the annular-mist flow mixture is withdrawn resulting in the at least partial atomization of the liquid stream to form an atomized liquid stream. The atomized liquid stream is then uniformly distributed by nozzle 106 into a medium such as, but not limited to, air or a fluidized catalyst. Nozzles suitable for use in the present invention can include any nozzle configuration effective for uniformly distributing a liquid stream into a medium as described above. In particular, suitable nozzles include BETE® nozzles manufactured by Bete Fog Nozzle, Inc.

Figure 4:
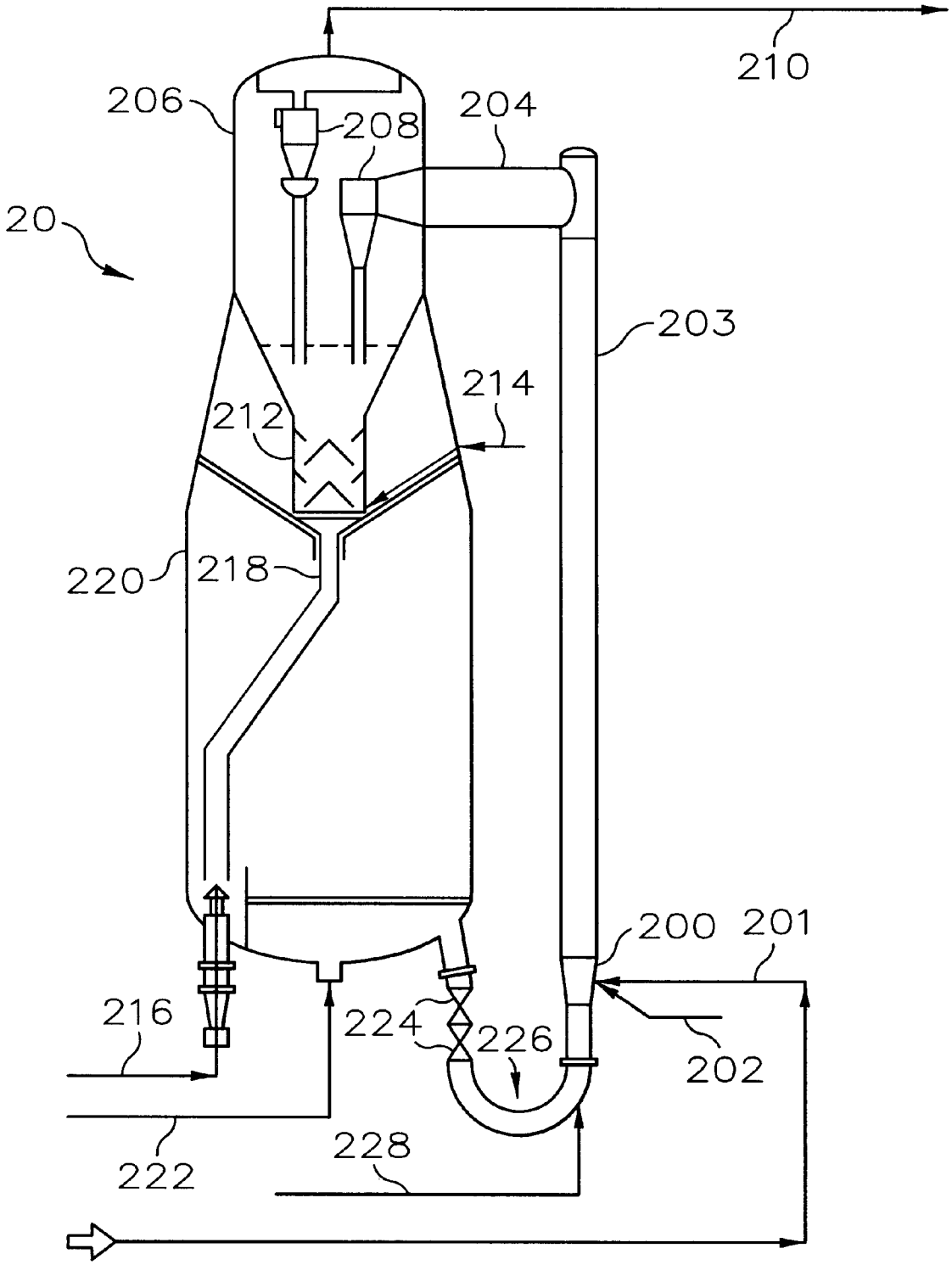
FIG. 4 schematically illustrates certain features of one type of FCC unit embodying certain features of the atomizer of the present invention.

FIG. 4 shows one type of FCC unit 20 which comprises a feed injection zone 200 having incorporated therein the inventive atomizer 10 of FIG. 1. Feed injection zone 200 is connected in fluid flow communication with an oil feed line 201, an atomizing enhancing medium line 202 and a riser reactor 203. A conduit 204 connects riser reactor 203, in fluid flow communication, with a catalyst/product separation zone 206 which usually contains several cyclone separators 208 and is connected in fluid flow communication with a conduit 210 for withdrawal of an overhead product from catalyst/product separation zone 206. Catalyst/product separation zone 206 is connected in fluid flow communication with a stripping section 212 in which gas, preferably steam, is introduced from lines 214 and 216 and strips entrained hydrocarbon from spent catalyst. Conduit or stand pipe 218 connects stripping section 212, in fluid flow communication, with a regeneration zone 220. Regeneration zone 220 is connected in fluid flow communication with a conduit 222 for introducing air to regeneration zone 220. Manipulative valve 224 (preferably a slide valve) connects regeneration zone 220, in fluid flow communication, with a catalyst conveyance zone 226. Catalyst conveyance zone 226 is connected in fluid flow communication with the feed injection zone 200. Catalyst conveyance zone 226 is also connected in fluid flow communication with a conduit 228 for introducing fluidizing gas into catalyst conveyance zone 226.

Figure 5:
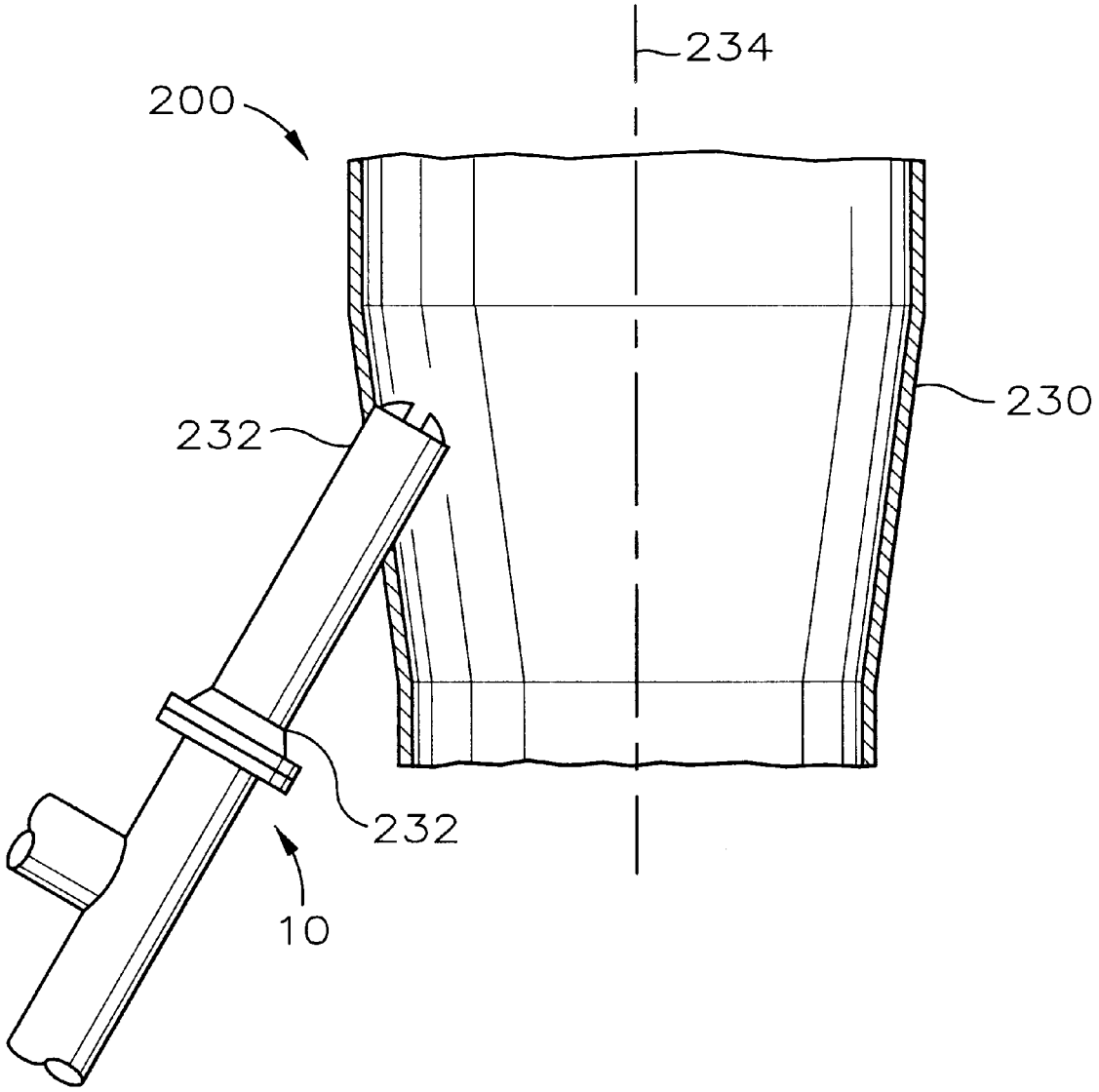
FIG. 5 is an enlarged cut-away view showing in greater detail certain features of the feed injection zone of the FCC unit shown in FIG. 4.
Figure 6:
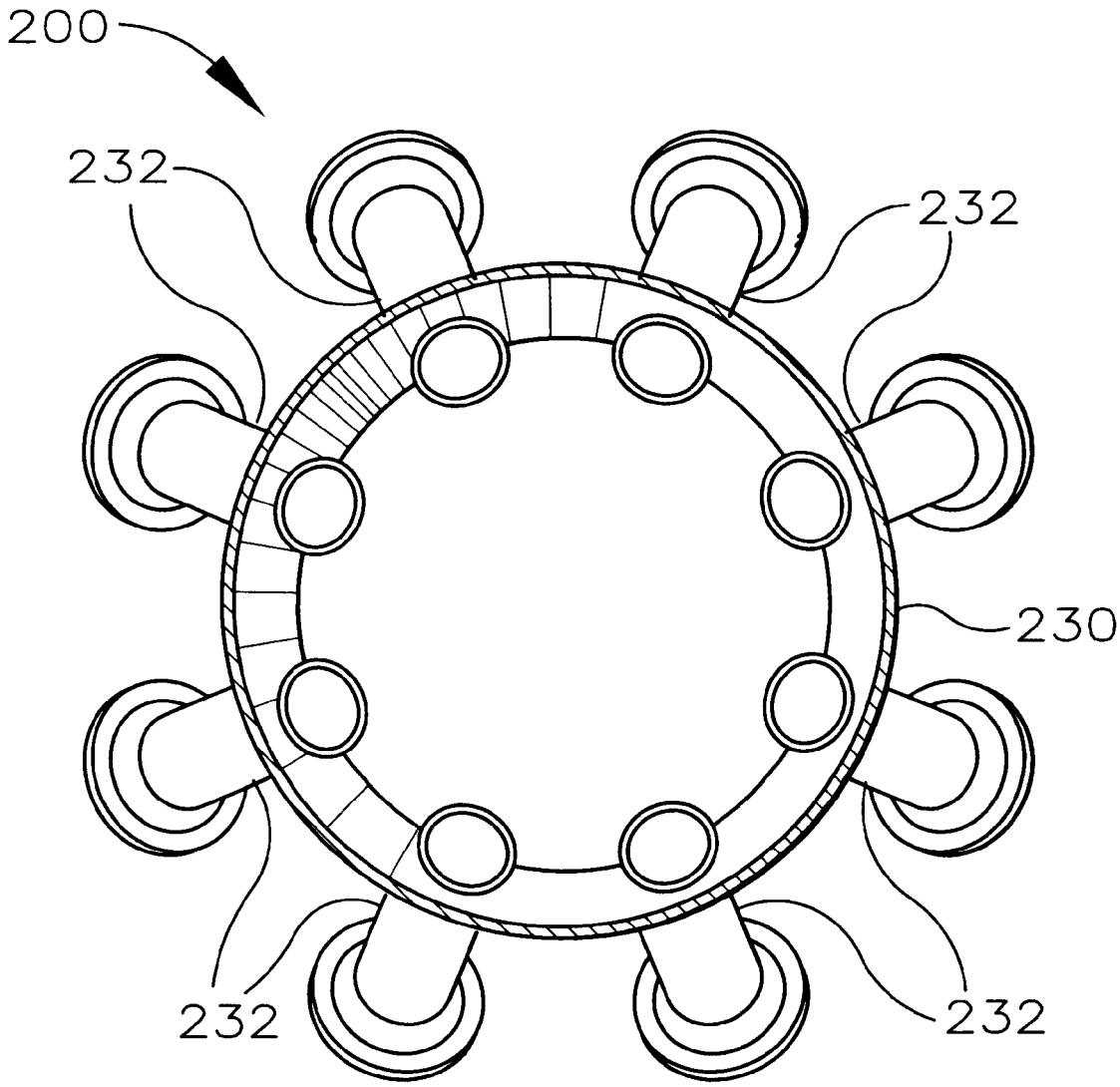
FIG. 6 is an enlarged sectional view showing in greater detail certain features of the feed injection zone shown in FIGS. 4 and 5.

Referring to FIGS. 5 and 6, therein is illustrated, in greater detail, feed injection zone 200 from FIG. 4 including a frustroconical section 230, a typical guide 232 and the inventive atomizer 10.

The frustoconical section 230 is situated in an inverted manner and has a centerline axis 234. That is, the frustom end is situated below the base end, and the frustom and base ends are open to flow.

In one embodiment, FIG. 6 represents a downwardly looking sectional view of feed injection zone 200 which illustrates the configuration of a plurality of guides 232 about frustoconical section 230 in which the atomizers 10 (not depicted in FIG. 6) are positioned. Referring again to FIG. 5, atomizer 10 is fixedly secured to guide 232 and is in fluid flow communication with frustoconical section 230 of the feed injection zone 200. Atomizer 10 can be fixedly secured to guide 232 by any means sufficient to provide a suitable seal. Preferably, atomizer 10 is either welded or bolted to guide 232.

Regarding the operation of the FCC unit 20, and referring again to FIG. 4, an oil stream and an atomizing enhancing medium are introduced to feed injection zone 200 through lines 201 and 202, respectively, for contact with regenerated fluidized catalyst from catalyst conveyance zone 226 (described in greater detail below). The contacting of the oil stream with the regenerated catalyst catalyzes the conversion of the oil stream to gasoline range and lighter hydrocarbons as the mixture passes up the riser reactor 203. As the oil stream is cracked the catalyst is progressively deactivated by the accumulation of hydrocarbons and coke on the surface and in the interstitial spaces of the catalyst. This partially deactivated catalyst is thereafter referred to as spent catalyst and passes from riser reactor 203 to catalyst/product separation zone 206 via conduit 204. Hydrocarbon product gases and spent catalyst separate in catalyst/product separation zone 206 and the hydrocarbon product gases exit through conduit 210 with the spent catalyst flowing downwardly. The spent catalyst passes down through stripping section 212 and is stripped of its hydrocarbons by counter flowing stripping gas from conduits 214 and 216. The stripped catalyst flows downwardly to regeneration zone 220 via conduit 218 where the stripped catalyst is reactivated by burning off any remaining coke deposits with air supplied via conduit 222. The regenerated catalyst then flows to the catalyst conveyance zone 226 wherein fluidizing gas from conduit 228, preferably steam, fluidizes the regenerated catalyst and aids in passing the regenerated catalyst to the feed injection zone 200. In describing in more detail the performance of atomizer 10 when used in FCC unit 20, reference is made to FIG. 1.

Referring again to FIG. 1, and the operation of the atomizer 10, an oil stream is introduced to the upstream end portion 112 of first conduit 100. The oil stream then flows around perforated-pipe sparger 118 through the first cross sectional area ($A_{xs1}$).

$A_{xs1}$ preferably has a value such that the mass flux of the oil stream ($MF_1$) around perforated-pipe sparger 118 is in the range of from about 625 lbm/(ft$^2$ sec) to about 1050 lbm/(ft$^2$ sec); preferably in the range of from about 700 lbm/(ft$^2$ sec) to about 975 lbm/(ft$^2$ sec); and most preferably from 775 lbm(ft$^2$ sec) to 900 lbm/(ft$^2$ sec). The mass flux of the oil stream is defined by the formula:

$$MF_1=\frac{m_1}{A_{xs1}};$$

wherein $m_1$=mass flow rate of the oil stream in lbm/sec; and $A_{xs1}$=cross sectional area in $ft^2$.

An atomizing enhancing medium, preferably steam, is introduced to second conduit 102, flows into perforated-pipe sparger 118 of second conduit 102 and exits perforated-pipe sparger 118 through the total second cross sectional area $A_{xs2}$ of the plurality of holes 128. $A_{xs2}$ preferably has a value such that the mass flux of the atomizing enhancing medium ($MF_2$) at the point of exit from the plurality of holes 128 is in the range of from about 30 lbm/($ft^2$ sec) to about 50 lbm/($ft^2$ sec), preferably in the range of from about 32 lbm/($ft^2$ sec) to about 48 lbm/($ft^2$ sec;) and most preferably from 35 lbm/($ft^2$ sec) to 45 lbm/($ft^2$ sec). The mass flux of the atomizing enhancing medium is defined by the formula:

$$MF_2 = \frac{m_2}{A_{xs2}};$$

wherein $m_2$=mass flow rate of the atomizing enhancing medium in lbm/sec; and $A_{xs2}$=cross sectional area in $ft^2$.

Upon exit from the plurality of holes 128, the atomizing enhancing medium contacts the oil stream thereby forming a turbulent mixture of the oil stream and the atomizing enhancing medium. The atomizing enhancing medium has a gas velocity number ($N_{gv}$) and the oil stream has a liquid velocity number ($N_{LV}$), both defined below. Preferably, diameter $D_3$ of third conduit 104 has a value such that, as $N_{LV}$ is varied, $N_{gv}$ exceeds:

$10^z$; wherein:

$z=(1.401-2.694\ N_L+0.521(N_{LV})^{0.329})$;

$N_{gv}=V_{sg}(\rho_L\ g_c/g\sigma_L)^{1/4}$;

$N_{Lv}=V_{sL}(\rho_L\ g_c/g\sigma_L)^{1/4}$;

$$V_{sg} = \frac{m_2}{A_{xs3}\rho_v};$$

$$V_{sL} = \frac{m_1}{A_{xs3}\rho_L};$$

$A_{xs3}=\pi\ (D_3)^2/4$ $N_L$=viscosity of the oil stream in lbm/ft sec;

$\rho_L$=the oil stream density in $lbm/ft^3$;

$\rho_v$=the atomizing enhancing medium density in $lbm/ft^3$;

$g_c$=gravitational constant;

g=acceleration due to gravity;

$\sigma_L$=surface tension of the oil stream in lbf/ft; and $A_{xs3}$=cross sectional area of the third conduit in $ft^2$.

Where the value of $D_3$ is as described above, the turbulent mixture, upon passing from downstream end portion 114 of first conduit 100 to third conduit 104, will be converted in the third conduit 104 to an annular-mist flow mixture which is necessary in order to produce atomization of the oil stream at the exit of the nozzle. The annular-mist flow mixture is preferably substantially circumferentially uniform. The annular-mist flow mixture can then be passed to nozzle 106 from which the annular-mist flow mixture is withdrawn resulting in the at least partial atomization of the oil stream to form an atomized oil stream. The atomized oil stream is then uniformly distributed by nozzle 106 into the regenerated fluidized catalyst from catalyst conveyance zone 226 which is flowing through the frustoconical section 230 of the feed injection zone 200.

Efficient atomizers in an FCC unit must both atomize the oil feed and distribute the oil feed uniformly to the riser reactor. The atomizers must be designed to produce a droplet size distribution, which can be vaporized and catalytically reacted in the riser reactor's residence time. The products of this vaporization process are gaseous hydrocarbons and a residual aerosol composed of high temperature boilers. While the vapor products can react catalytically, the residual aerosols are adsorbed onto the available surfaces (particles and wall) and thermally decompose. If the riser reactor performance is poor, the residual aerosols can be carried over to the main fractionator where it can present a potential stability problem.

In addition to atomization, the efficient vaporization of the feed oil requires good distribution of the feed oil over the cross section of the riser reactor. This allows uniform contacting of the oil with the hot regenerated catalyst. The nature of the spray from the atomizer must be matched to the density of the catalyst entering the mix zone. If this is done correctly, the spray will penetrate the dense catalyst and fully distribute. If not, the spray from the atomizer may be bent upward and not fully contact the catalyst. This inefficient contacting can result in eddies which drag part of the feed oil down below the mix zone. As a result, selectivities and throughput will suffer. Overall, the properly designed atomizer acts to limit the external mass transfer resistance between the oil and the catalyst particle by good atomization and distribution.

When the atomizer performance is good, one should see trends in various indices as the catalyst to oil (C/O) ratio varies. Specifically, the external mass transport of the vaporized feed to the catalyst particles will not be limiting. As a result, when the C/O ratio is increased, the number of active sites available on the catalyst will increase, the extent of catalytic reactions should increase, and the extent of thermal reactions should decrease. These trends should appear in hydrogen transfer and thermal cracking indices. The hydrogen transfer should increase and the thermal cracking should decrease. This shift impacts the riser reactor's heat of cracking and the overall unit coke make.

The hydrogen transfer index is defined as the ratio of the isobutane yield to the isobutene yield. Hydrogen transfer is a strongly exothermic bimolecular catalytic reaction which dehydrogenates one unsaturated molecule and hydrogenates the other unsaturated molecule. The index represents the extent of the hydrogen transfer reaction by comparing the amount of isobutane, which is an end product of hydrogen transfer, and the amount of isobutene, which is an end product of catalytic cracking.

The thermal cracking index is defined as the ratio of the yield of the ethane and lighter components to the yield of isobutene. The thermal cracking reaction is noncatalytic and endothermic. Ethane and lighter components are the end products of thermal cracking, while isobutene is an end product of catalytic cracking. This index is a gage of the extent of thermal cracking compared to catalytic cracking.

Whereas this invention has been described in terms of the preferred embodiments, reasonable variations and modifications are possible by those skilled in the art. Such modifications are within the scope of the described invention and appended claims.

That which is claimed is:

1. An atomizer comprising:

a first conduit having a longitudinal axis, an inside wall, an inside diameter $D_1$, an upstream end portion, a downstream end portion, and an opening in said inside wall intermediate said upstream end portion and said downstream end portion;

a second conduit having a perforated-pipe sparger at one end thereof for introducing an atomizing enhancing medium to said first conduit; said perforated-pipe sparger having a longitudinal axis and being disposed within said first conduit through said opening in said inside wall with the longitudinal axis of said perforated-pipe sparger being in a generally perpendicular relation to the longitudinal axis of said first conduit; said perforated-pipe sparger having an outside surface, a first end, a closed second end, an outside diameter $D_2$, a length $L_1$ within said first conduit and a plurality of holes facing generally in the direction of the downstream end portion of said first conduit; the outside surface at said first end of said perforated-pipe sparger being in sealing engagement with said opening in said inside wall of said first conduit; and a third conduit having an inside diameter $D_3$, said third conduit being connected in fluid flow communication with the downstream end portion of said first conduit.

2. An atomizer in accordance with claim 1 further characterized to include a nozzle connected in fluid flow communication with said third conduit.

3. An atomizer in accordance with claim 1 wherein said outside surface of said perforated-pipe sparger and said inside wall of said first conduit define a first cross sectional area ($A_{xs1}$) having a value such that the mass flux of a liquid stream flowing through said first conduit ($MF_1$) and around said perforated-pipe sparger is in the range of from about 625 lbm/(ft$^2$ sec) to about 1050 lbm/(ft$^2$ sec); $MF_1$ being defined by the formula:

$$MF_1 = \frac{m_1}{A_{xs1}};$$

$m_1$=mass flow rate of said liquid stream in lbm/sec; and $A_{xs1}$=cross sectional area in ft$^2$.

4. An atomizer in accordance with claim 1 wherein said plurality of holes in said perforated-pipe sparger has a total second cross sectional area ($A_{xs2}$) having a value such that the mass flux of said atomizing enhancing medium ($MF_2$) at the point of exit from said plurality of holes is in the range of from about 30 lbm/(ft$^2$ sec) to about 50 lbm/(ft$^2$ sec); $MF_2$ being defined by the formula:

$$MF_2 = \frac{m_2}{A_{xs2}};$$

wherein $m_2$=mass flow rate of said atomizing enhancing medium in lbm/sec; and $A_{xs2}$=cross sectional area in ft$^2$.

5. An atomizer in accordance with claim 1 wherein:

$(D_1-D_2)/2$ is substantially equivalent to $(D_1-L_1)$.

6. An atomizer in accordance with claim 1 wherein said plurality of holes in said perforated-pipe sparger is further characterized to include a plurality of rows of holes each generally parallel to the longitudinal axis of said perforated-pipe sparger, said plurality of rows of holes including a center row, a first side row and a second side row, wherein the axes of the holes in said first side row lie in a first plane intersecting the longitudinal axis of said perforated-pipe sparger, wherein the axes of the holes in said second side row lie in a second plane intersecting the longitudinal axis of said perforated-pipe sparger, wherein the axes of the holes in said center row lie in a third plane intersecting the longitudinal axis of said perforated-pipe sparger, wherein a first angle between said first plane and said third plane is in the range of from about 40° to about 50°, wherein a second angle between said second plane and said third plane is in the range of from about 40° to about 50°, and wherein a third angle between said first plane and said second plane is in the range of from about 80° to about 100°.

7. An atomizer in accordance with claim 6 wherein said first side row and said second side row include in the range of from about 70% to about 90% of the total cross sectional area of said plurality of holes in said perforated-pipe sparger.

8. An atomizer in accordance with claim 1 wherein when said atomizing enhancing medium has a gas velocity number ($N_{gv}$) and a liquid stream flowing through said first conduit has a liquid velocity number ($N_{Lv}$), then $D_3$ has a value such that, as $N_{Lv}$ is varied, $N_{gv}$ exceeds:

$10^z$; wherein:

$z=(1.401-2.694\ N_L+0.521(N_{LV})^{0.329})$;

$N_{gv}=V_{sg}(\rho_L\ g_c/g\sigma_L)^{1/4}$;

$N_{Lv}=V_{sL}(\rho_L\ g_c/g\sigma_L)^{1/4}$;

$$V_{sg} = \frac{m_2}{A_{xs3}\rho_v};$$

$$V_{sL} = \frac{m_1}{A_{xs3}\rho_L};$$

$A_{xs3}=\pi\ (D_3)^2/4$ $N_L$=viscosity of said liquid stream in lbm/ft sec;

$\rho_L$=said liquid stream density in lbm/ft$^3$;

$\rho_v$=said atomizing enhancing medium density lbm/ft$^3$;

$g_c$=gravitational constant;

g=acceleration due to gravity;

$\sigma_L$=surface tension of said liquid stream in lbf/ft;

$m_1$=mass flow rate of said liquid stream in lbm/sec;

$m_2$=mass flow rate of said atomizing enhancing medium in lbm/sec; and $A_{xs3}$=cross sectional area of said third conduit in ft$^2$.

9. An atomizer in accordance with claim 1 wherein said atomizing enhancing medium is steam.

10. An atomizer in accordance with claim 3 wherein said liquid stream is an oil stream.

11. A method for atomizing a liquid stream comprising:

providing the atomizer of claim 1;

introducing a liquid stream to said upstream end portion of said first conduit;

introducing an atomizing enhancing medium through said perforated-pipe sparger via said second conduit;

contacting said liquid stream with said atomizing enhancing medium downstream from said plurality of holes of said perforated-pipe sparger thereby forming a turbulent mixture of said liquid stream and said atomizing enhancing medium;

passing said turbulent mixture to said third conduit thereby converting said turbulent mixture into an annular-mist flow mixture;

passing said annular-mist flow mixture to a nozzle; and withdrawing said annular-mist flow mixture from said nozzle thereby at least partially atomizing said liquid stream to form an atomized liquid stream.

12. A method in accordance with claim 11 wherein said annular-mist flow mixture is substantially circumferentially uniform within said nozzle.

13. A method in accordance with claim 11 wherein said outside surface of said perforated-pipe sparger and said inside wall of said first conduit define a first cross sectional area ($A_{xs1}$) having a value such that the mass flux of said liquid stream ($MF_1$) around said perforated-pipe sparger is in the range of from about 625 lbm/(ft$^2$ sec) to about 1050 lbm/(ft$^2$ sec); $MF_1$ being defined by the formula:

$$MF_1 = \frac{m_1}{A_{xs1}};$$

wherein $m_1$=mass flow rate of said liquid stream in lbm/sec; and $A_{xs1}$=cross sectional area in ft$^2$.

14. A method in accordance with claim 11 wherein said plurality of holes in said perforated-pipe sparger has a total second cross sectional area ($A_{xs2}$) having a value such that the mass flux of said atomizing enhancing medium ($MF_2$) at the point of exit from said plurality of holes is in the range of from about 30 lbm/(ft$^2$ sec) to about 50 lbm/(ft$^2$ sec); $MF_2$ being defined by the formula:

$$MF_2 = \frac{m_2}{A_{xs2}};$$

$m_2$=mass flow rate of said atomizing enhancing medium in lbm/sec; and $A_{xs2}$=cross sectional area in ft$^2$.

15. A method in accordance with claim 11 wherein:

$(D_1-D_2)/2$ is substantially equivalent to $(D_1-L_1)$.

16. A method in accordance with claim 11 wherein said plurality of holes in said perforated-pipe sparger is further characterized to include a plurality of rows of holes each generally parallel to the longitudinal axis of said perforated-pipe sparger, said plurality of rows of holes including a center row, a first side row and a second side row, wherein the axes of the holes in said first side row lie in a first plane intersecting the longitudinal axis of said perforated-pipe sparger, wherein the axes of the holes in said second side row lie in a second plane intersecting the longitudinal axis of said perforated-pipe sparger, wherein the axes of the holes in said center row lie in a third plane intersecting the longitudinal axis of said perforated-pipe sparger, wherein a first angle between said first plane and said third plane is in the range of from about 40° to about 50°, wherein a second angle between said second plane and said third plane is in the range of from about 40° to about 50°, and wherein a third angle between said first plane and said second plane is in the range of from about 80° to about 100°.

17. A method in accordance with claim 16 wherein said first side row and said second side row include in the range of from about 70% to about 90% of the total cross sectional area of said plurality of holes in said perforated-pipe sparger.

18. A method in accordance with claim 11 wherein when said atomizing enhancing medium has a gas velocity number ($N_{gv}$) and said liquid stream has a liquid velocity number ($N_{Lv}$), then $D_3$ has a value such that, as $N_{Lv}$ is varied, $N_{gv}$ exceeds:

$10^Z$; wherein:

$z=(1.401-2.694\ N_L+0.521(N_{LV})^{0.329})$;

$N_{gv}=V_{sg}(\rho_L\ g_c/g\sigma_L)^{1/4}$;

$N_{Lv}=V_{sL}(\rho_L\ g_c/g\sigma_L)^{1/4}$;

$$V_{sg} = \frac{m_2}{A_{xs3}\rho_v};$$

$$V_{sL} = \frac{m_1}{A_{xs3}\rho_L};$$

$A_{xs3}=\pi\ (D_3)^2/4$ $N_L$=viscosity of said liquid stream in lbm/ft sec;

$\rho_L$=said liquid stream density in lbm/ft$^3$;

$\rho_v$=said atomizing enhancing medium density lbm/ft$^3$;

$g_c$=gravitational constant;

g=acceleration due to gravity;

$\sigma_L$=surface tension of said liquid stream in lbf/ft;

$m_1$=mass flow rate of said liquid stream in lbm/sec;

$m_2$=mass flow rate of said atomizing enhancing medium in lbm/sec; and $A_{xs3}$=cross sectional area of said third conduit in ft$^2$.

19. A method in accordance with claim 11 wherein said atomizing enhancing medium is steam.

20. A method in accordance with claim 11 wherein said liquid stream is an oil stream.

21. A method in accordance with claim 20 wherein said atomized liquid stream is uniformly distributed into a fluidized catalyst upon exit from said nozzle.

22. A method in accordance with claim 20 wherein said atomized liquid stream is uniformly distributed into a fluidized catalyst upon exit from said nozzle and within a fluidized catalytic cracking unit.

23. A method in accordance with claim 20 wherein said atomized liquid stream is uniformly distributed into a fluidized catalyst upon exit from said nozzle and within a fluidized coker unit.

* * * * *

UNITED STATES PATENT AND TRADEMARK OFFICE

CERTIFICATE OF CORRECTION

PATENT NO. : 6,179,997 B1 
DATED : January 30, 2001
INVENTOR(S) : William J. Vedder, Jr. and Jan W. Wells It is certified that error appears in the above-identified patent and that said Letters Patent is hereby corrected as shown below:

Column 9, claim 3,
Line 35, please insert -- ; wherein --.

Column 11, claim 14,
Line 23, please insert -- ; wherein --.

Signed and Sealed this

Twenty-sixth Day of February, 2002

*Attest:*

*Attesting Officer*

JAMES E. ROGAN
*Director of the United States Patent and Trademark Office*